US005413649A

United States Patent [19]

Dunand et al.

[11] Patent Number: 5,413,649

[45] Date of Patent: May 9, 1995

[54] METHOD FOR ENHANCING SUPERPLASTICITY IN COMPOSITES

[75] Inventors: David C. Dunand, Cambridge, Mass.; Cynthia M. Bedell, Westpoint, N.Y.

[73] Assignee: Massachusetts Institute of Technology, Cambridge, Mass.

[21] Appl. No.: 99,824

[22] Filed: Jul. 29, 1993

[51] Int. Cl.[6] ..... C21D 8/00

[52] U.S. Cl. ..... 148/564; 148/670; 420/902; 72/364; 72/709; 264/56

[58] Field of Search ..... 148/564, 670, 671; 420/902; 72/364, 709; 264/55, 56

[56] References Cited

U.S. PATENT DOCUMENTS

| | | | |
|---|---|---|---|
| 4,263,375 | 4/1981 | Elrod | 428/594 |
| 4,722,755 | 2/1988 | Maehara | 148/564 |
| 5,080,727 | 1/1992 | Aihara et al. | 148/670 |

FOREIGN PATENT DOCUMENTS 4-365362 12/1992 Japan .

OTHER PUBLICATIONS

C. M. Bedell et al., "Transformation Induced Superplasticity of Reinforced Titanium", *Research in Materials Annual Report,* compiled by Center for Materials Science and Engineering, Massachusetts Institute of Technology, Cambridge, Mass. 02139 USA, Abstract No. 3.0, Jul. 31, 1992.

Mu Yeh Wu et al., "Internal Stress Superplasticity in Anisotropic Polycrystalline Zinc and Uranium", Metallurgical Transactions A, 18A, pp. 451–462, 1987.

S. M. Pickard, "The Deformation of Particle Reinforced Metal Matrix Composites During Temperature Cycling", Acta metall. mater., 38, pp. 2537–2552, 1990.

Mu Yeh Wu and Oleg D. Sherby, "Superplasticity in a Silicon Carbide Whisker Reinforced Aluminum Alloy", Scripta Metallurgica, 18, pp. 773–776, 1984.

Yong-Ching Chen et al., "The Potential for Forming Metal Matrix Composite Components Via Thermal Cycling", Scripta Metallurgica et Materialia, 24, pp. 2157–2162, 1990.

Glenn S. Daehn, "Plastic Deformation of Continuous-Fiber Reinforced Composites Subjected to Changing Temperature", Scripta Metallurgica, 23, pp. 247–252, 1989.

T. J. Warner et al., "Phase Transformations in MMC Reinforcements", *Fundamental Relationships Between Microstructure & Mechanical Properties of Metal-Matrix Composites,* (eds.) P. K. Liaw & M. N. Gungor, The Minerals, Metals & Materials Society, pp. 313–324, 1990.

C. A. Lewis et al., "Transformation-Induced Stress Relief In Aluminium-Zirconia MMCs", *Metal Matrix Composites-Processing, Microstructure and Properties,* 12th Riso International Symposium on Materials Science, pp. 483–488, 1991.

A. R. T. de Silva et al., "Thermal Stresses in Fiber Reinforced Composites", J. Mech. Phys. Solids, 17, pp. 387–403, 1969.

G. W. Greenwood et al., "The deformation of metals under small stresses during phase transformations", Proc. Roy. Soc., 283, pp. 403–422, 1965.

J. P. Poirier, "On Transformation Plasticity", Journal of Geophysical Research, 87, pp. 6791–6797, 1982.

H. Baker et al., (eds), *ASM Handbook Vol. 3,* ASM (List continued on next page.)

*Primary Examiner*—George Wyszomierski

*Attorney, Agent, or Firm*—Florence Fusco McCann

[57] ABSTRACT

A method for inducing superplasticity in a composite including a non-transforming phase and a transforming phase by cycling the composite material through a phase transformation of the transforming phase while applying an external stress to the composite material is provided as is a method for inducing superplasticity in a titanium/titanium carbide composite. Also provided is a method for forming a part from a composite material including a transforming phase and a non-transforming phase by cycling the composite through a phase transformation of the transforming phase and shaping the composite material by applying an external stress to the composite material while the transforming phase is undergoing a phase transformation to form a finished article.

60 Claims, 8 Drawing Sheets

OTHER PUBLICATIONS

International, Materials Park, Ohio (1992), Appendices 4.7, 4.9 and 4.11.

J. L. Hart et al., "Superplasticity in Pure $ZrO_2$", Mat. Res. Bull., 2, pp. 521–526, 1967.

C. A. Johnson et al., "Transformational Superplasticity in Pure $Bi_2O_3$ and athe $Bi_2O_3$–$Sm_2O_3$ Eutectoid System", *Deformation of Ceramic Materials,* Plenum Press, New York, pp. 443–453, 1975.

M. de Jong et al., "Mechanical Properties of Iron and Some Iron Alloys While Undergoing Allotropic Tranformation", Acta Metallurgica, 7, pp. 246–253, 1959.

METHOD FOR ENHANCING SUPERPLASTICITY IN COMPOSITES

BACKGROUND OF THE INVENTION

1. Field of the Invention

The invention relates to methods for inducing superplastic deformation in a composite. More particularly, the invention relates to cycling a composite material including a transforming phase through a phase transformation of the transforming phase while applying an external stress to the composite material to induce superplastic deformation.

2. Description of the Prior Art

The phenomenon of superplastic deformation (i.e. deformation of a material at low stresses and to very large strains before failure) is known to exist in bulk metals and ceramics. The term "bulk" is used to refer to a non-composite material which is single phase on a macroscopic scale.

Superplastic deformation of such bulk materials can result from internal stress caused by anisotropy in the thermal expansion coefficient of the material as described by Wu et al., "Internal Stress Superplasticity in Anisotropic Polycrystalline Zinc and Uranium", Metallurgical Transactions A, 18A, 451–462 (1987). Bulk material superplastic deformation behavior can also be induced by a phase transformation of the material as reported by de Jong et al., "Mechanical Properties of Iron and Some Iron Alloys While Undergoing Allotropic Transformation", Acta Metallurgica, 7, 246–253 (1959) for bulk iron and iron alloy metals. Also, superplastic deformation behavior in a bulk metal can be the result of the particular grain structure characteristic of the metal such as the fine grain-induced superplasticity of bulk titanium metal described in U.S. Pat. No. 4,263,375, to Elrod, issued Apr. 21, 1981.

In composite materials, where at least two distinct phases are macroscopically identifiable, superplastic deformation behavior resulting from thermal cycling has been observed and is attributed to the difference between the coefficients of thermal expansion of the matrix phase material and of the reinforcement phase material as described, for example, by Pickard et al., "The Deformation of Particle Reinforced Metal Matrix Composites During Temperature Cycling", Acta metall. mater., 38, 2537–2552 (1990).

Metal matrix composites of particular interest for many industrial applications are titanium metal matrix composites. Titanium is prized for its specific strength and specific stiffness at both ambient and elevated temperatures. However, titanium lacks the stiffness needed for some aerospace applications. Adding ceramic particles or fibers to a titanium matrix increases the strength-to-weight and stiffness-to-weight ratios. However, titanium and its alloys are difficult to work because of their resistance to deformation at the optimum hot-working temperature. Titanium matrix composites are even more difficult to form and machine.

Currently, superplastic forming of titanium is accomplished by using the phenomenon of fine grained superplasticity. This type of superplasticity is limited by restrictions on the temperature range, strain rate, $\dot{\epsilon}$, and grain size. Fine grained superplastic forming can only be accomplished at small strain rates. This limits the rate at which titanium parts can be produced. Another problem with superplastic forming is the requirement that a small grain size be maintained throughout the superplastic deformation.

Pure titanium is characterized by an allotropic metal phase transformation: below 882° C., its structure is hexagonal-close-packed (hcp, $\alpha$ phase). Above 882° C., the hcp structure transforms to body centered cubic (bcc, $\beta$ phase) which is mechanically weaker than the $\alpha$ phase. Weakening of mechanical properties also occurs during the $\alpha 77 \rightarrow \beta$ transformation. This weakening manifests itself by:

1. an enhanced creep rate for deformation at constant stress, or
2. a stress drop for constant strain-rate tests and is referred to as transformation plasticity. This phenomenon results from an interaction between the internal stresses from the phase transformation and the macroscopic stresses from the external load.

Thus, there exists a need for a method for inducing superplasticity in a composite and for forming a part from a composite material including a phase which undergoes a phase transformation which allows for the forming of composites which are typically difficult to form, and likely to fail at low strains, and which provides enhanced strain per cycle, resulting in faster composite deformation and, thus, less time to form a part. There exists a particular need for such an efficient forming process for industrially important titanium/titanium carbide composites. A low-to-moderate temperature method to form these titanium composites could reduce the cost of shaping the high performance parts needed by many industries.

SUMMARY OF THE INVENTION

The invention provides a method for inducing superplasticity in a composite material including a first non-transforming phase and a first transforming phase by cycling the composite material through a phase transformation of the first transforming phase and applying an external stress to the composite material so that superplastic deformation is induced in the composite.

In another aspect of the invention, a method is provided for forming a part from a composite material by providing a composite material including a first non-transforming phase and a first transforming phase; cycling the composite material through a phase transformation of the first transforming phase; and shaping the composite material by applying an external stress to the composite material while the first transforming phase is undergoing a phase transformation to result in a finished part.

According to yet another embodiment of the invention, a method is provided for inducing superplasticity in a Ti/TiC composite by providing a Ti/TiC composite material including a first TiC non-transforming phase and a first Ti transforming phase; thermally cycling the first Ti transforming phase through a Ti phase transformation; and applying an external stress to the Ti/TiC composite material so that superplastic deformation is induced in the Ti/TiC composite during each step of thermal cycling.

It is an object of this invention to provide methods for the forming of composites which are otherwise difficult to form and subject to failure at low strains.

A further object of the invention is to provide methods for forming a composite material or for forming a part therefrom characterized by enhanced strain per cycle which results in faster deformation of the composite material and thus less time to form a finished part from the composite material.

Another object of the invention is provision of such a superplastic forming process for typically difficult to form Ti/TiC composites.

Other and further objects, features and advantages of the present invention will be readily apparent to those skilled in the art in reading the description of the preferred embodiments which follows.

DETAILED DESCRIPTION OF THE INVENTION

Figure 1:
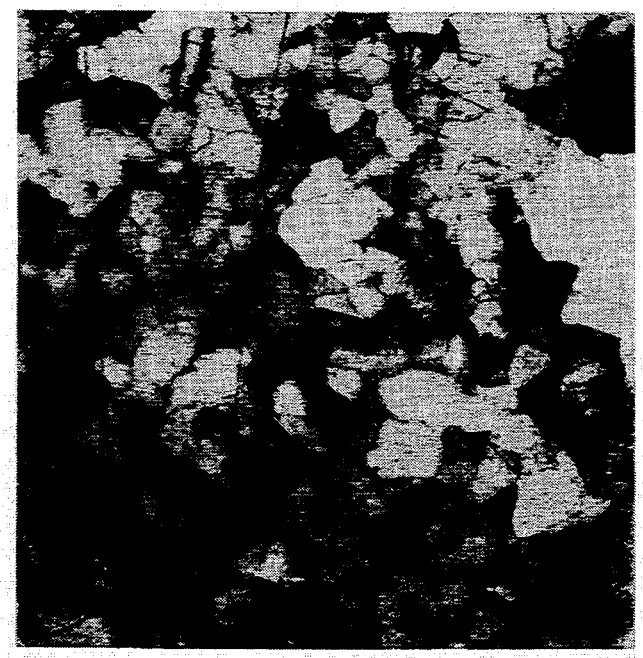
FIG. 1 is an optical micrograph showing the microstructure of a Ti sample before processing according to the method of the invention.

The invention provides a method for inducing superplasticity in a composite material which includes a first non-transforming phase and a first transforming phase by cycling the composite material through a phase transformation of the first transforming phase and applying an external stress to the composite material so that superplastic deformation is induced in the composite material which can be in excess of the superplastic deformation which would occur as a result of the phase transformation alone in the bulk transforming material.

As used herein in the specification and in the claims, the term "composite" refers to a material made up of at least two phases such as, for example, a matrix phase and a reinforcement phase. Also, as used herein in the specification and claims, a superplastic deformation is a deformation at low stresses and to very large tensile strains before failure of the material and characterized by a stress exponent, n, close to 1 according to the formula $$\dot{\epsilon} = A\,\sigma^n \exp\left(\frac{-Q}{RT}\right)$$

wherein $\epsilon$ is the strain rate, A is a materials constant, $\sigma$ is the stress, Q is an activation energy, R is the gas constant and T is temperature.

The composite material can be a metal matrix composite, a ceramic matrix composite, an ionic matrix composite, a covalent matrix composite, a polymer matrix composite, or an intermetallic matrix composite. Metal matrix composites which can be used in the method of the invention include $Cu/Bi_2O_3$, $Ti/TiB_2$, $U/ThO_2$, Co/WC, $Sn/Al_2O_3$, Ti/TiC, Fe/TiC, or $Zr/ZrO_2$. Intermetallic matrix composites suitable for use in the method of the invention are $GaMn/ZrO_2$, NiTi/TiC or $Cr_5Ge_3/Y_2O_3$ based on atomic %. The composite can be a ceramic matrix composite such as $ZrO_2/Y_2O_3$, $Bi_2O_3/Al_2O_3$, $SiO_2/TiB_2$ and SiC/TiC. The composite can also be an ionic matrix composite such as $AgI/Al_2O_3$ or $CuS_2/TiC$. Finally, the composite can be a covalent matrix composite such as SiC/TiC, C/TiC or $Si/SiO_2$.

The transforming phase can be a material which undergoes a phase transformation from solid to liquid while the non-transforming phase remains solid, thereby inducing internal stress in the composite. For example, a lead/aluminum composite can be cycled around 327° C., the melting point of lead, to result in transformation of the lead from solid to liquid and creation of internal stresses which in the presence of an external stress enhances the superplastic deformation of the lead/aluminum composite.

The first transforming phase can be a material that undergoes a solid-solid phase transformation such as an allotropic, martensitic, eutectoid or peritectoid phase transformation. Such a phase transformation can result in a change in crystal structure of the transforming phase with an associated change in a physical characteristic such as volume, crystal habit, shape or orientation of the transforming phase. The transformation rate associated with the phase transformation should be sufficiently rapid to produce an industrially practical deformation rate and can range from about 1 second to about 1 hour.

The transforming phase can be an element, either a metal or a non-metal, such as titanium, iron, zirconium, cobalt, uranium, tin, ytterbium, manganese, sulfur, sodium or nitrogen. The first transforming phase can also be an alloy, either a disordered alloy or an ordered (intermetallic) alloy, such as $Cr_5Ge_3$, NiTi, Ti98-Al2, Fe99.95-C0.05, Zr50-Ti50 and Ga—Mn. These alloys exhibit the following phase transformations:

$Cr_5GE_3$ $\alpha \longleftrightarrow \beta$ at 1002° C.;

Ti98Al2 $\alpha \longleftrightarrow \alpha+\beta \longleftrightarrow \beta$ at 940° C. and 960° C., respectively;

Fe99.95C0.05 $\alpha \longleftrightarrow \alpha+\beta \longleftrightarrow \beta$ at 800° C. and 900° C., respectively;

Zr50Ti50 $\alpha \longleftrightarrow \beta$ at 605° C.; and

NiTi $\alpha \longleftrightarrow \beta$ at 50° C.

(All alloy compositions are specified in atomic %.) Some alloy phase transformations result in a mixture of more than one phase. The above-described phase transformation temperatures are specified for heating, since phase transformation temperatures upon cooling can be shifted by undercooling effects.

The first transforming phase can also be a ceramic material such as zirconia, bismuth oxide, quartz, iron oxide, manganese oxide, lead oxide, $As_2O_3$, TiO, $Ti_2O_3$, SiC or vanadium oxide.

The first transforming phase can be an ionic material, a material primarily characterized by ionic bonding, such as a salt, for example, AgI or $CuS_2$.

The transforming phase can undergo a martensitic phase transformation as is the case for Fe—C, Fe—N, Ni5OTi50, Ni65Al35, Ti, Co, Zr, Fe99.95C0.05, FeZrC or Fe96.5Cu3.5 with all compositions given in atomic %.

The transforming phase can also be a covalent compound, a material primarily characterized by covalent bonding, such as SiC, carbon which exhibits a high pressure phase transformation or silicon, which like carbon, exhibits a high pressure phase transformation. The transforming phase can be any mixed metal, i.e., alloy, a mixed ceramic or mixed ionic salt which is the mixture of any of the already-mentioned elements and/or compounds.

The composite material can also include a plurality of transforming phases, for example, in a $Zr/ZrO_2$ composite, both Zr and $ZrO_2$ have phase transformations which occur at different temperatures and additional steps of cycling at least one of the plurality of transforming phases through its phase transformation can be performed.

A transforming phase can also be a material which exhibits a magnetic phase transition which occurs along with a change from a first to a second crystal structure. Iron (Fe) is such a material and a phase transformation from the $\alpha$(bcc) to $\beta$(bcc) crystalline phase occurs at 771° C. where Fe also has a magnetic phase transition from a ferromagnetically ordered material to a disordered material. Application of an external magnetic field to a composite which includes a transforming phase like Fe can induce additional stress as spins reorient to align with the magnetic field.

A composite material can be chosen so that it includes a volume fraction of a first transforming phase selected so that the properties of the non-transforming phase such as its composition and ductility can accommodate the phase transformation of the volume fraction of the first transforming phase present while maintaining integrity of the composite and avoiding undesirable phenomena such as chemical reactivity, fracture and interface decohesion.

The step (2) of the method of cycling the composite material through the phase transformation can be accomplished by varying a phase transformation-inducing thermodynamic variable such as temperature, pressure, electric field or magnetic field. Table 1 provides a listing of elements which undergo temperature-induced phase transformations appropriate for the method of the invention as well as the temperatures at which these phase transformations occur. Table 2 provides a listing of elements which undergo pressure-induced phase transformations as well as the pressures at which these phase transformations occur. Finally, Table 3 provides a listing of ceramic and ionic materials which undergo temperature-induced phase transformations as well as the temperatures at which the phase transformations occur. Alloys can be formed from the elements listed in Tables 1 and 2 and, as such, depending upon the characteristics of their constituent elements can exhibit multiple phase transformations occurring at additional temperatures and/or pressures.

TABLE 1

Allotropic Phase Transformations at 1 atm

| Element | Transformation | Temperature (°C.) |
|---|---|---|
| Am | $\gamma \longleftrightarrow \beta$ | 1077 |
| Be | $\beta \longleftrightarrow \alpha$ | 1270 |
| Ca | $\beta \longleftrightarrow \alpha$ | 443 |
| Ce | $\delta \longleftrightarrow \gamma$ | 726 |
| | $\gamma \longleftrightarrow \beta$ | 61 |
| | $\beta \longleftrightarrow \alpha$ | −177 |
| Cf | $\beta \longleftrightarrow \alpha$ | 590 |
| Cm | $\beta \longleftrightarrow \gamma$ | 1277 |
| Co | $\alpha \longleftrightarrow \epsilon$ | 422 |
| Cr | $\alpha \longleftrightarrow \epsilon$ | 422 |
| Dy | $\beta \longleftrightarrow \alpha$ | 1381 |
| | $\alpha \longleftrightarrow \alpha'$ | −187 |
| F | $\beta \longleftrightarrow \alpha$ | −228 |
| Fe | $\delta \longleftrightarrow \gamma$ | 1394 |
| | $\gamma \longleftrightarrow \alpha$ | 912 |
| Gd | $\beta \longleftrightarrow \alpha$ | 1235 |
| Hf | $\beta \longleftrightarrow \alpha$ | 1743 |
| La | $\gamma \longleftrightarrow \beta$ | 865 |
| | $\beta \longleftrightarrow \alpha$ | 310 |
| Li | $\beta \longleftrightarrow \alpha$ | −193 |
| Mb | $\delta \longleftrightarrow \gamma$ | 1138 |
| | $\gamma \longleftrightarrow \beta$ | 1100 |
| | $\beta \longleftrightarrow \alpha$ | 727 |
| N | $\beta \longleftrightarrow \alpha$ | −238 |
| Na | $\beta \longleftrightarrow \alpha$ | −233 |
| Np | $\gamma \longleftrightarrow \beta$ | 576 |
| | $\beta \longleftrightarrow \alpha$ | 280 |
| O | $\gamma \longleftrightarrow \beta$ | −229 |
| | $\beta \longleftrightarrow \alpha$ | −249 |
| Pa | $\beta \longleftrightarrow \alpha$ | 1170 |
| Pm | $\beta \longleftrightarrow \alpha$ | 890 |
| Pr | $\beta \longleftrightarrow \alpha$ | 795 |
| Pu | $\epsilon \longleftrightarrow \delta'$ | 483 |
| | $\delta' \longleftrightarrow \delta$ | 463 |
| | $\delta \longleftrightarrow \gamma$ | 320 |
| | $\gamma \longleftrightarrow \beta$ | 215 |
| S | $\beta \longleftrightarrow \alpha$ | 95.5 |
| Sc | $\beta \longleftrightarrow \alpha$ | 1337 |
| Sm | $\gamma \longleftrightarrow \beta$ | 922 |
| | $\beta \longleftrightarrow \alpha$ | 734 |
| Sn | $\beta \longleftrightarrow \alpha$ | 13 |
| Sr | $\beta \longleftrightarrow \alpha$ | 547 |
| Tb | $\beta \longleftrightarrow \alpha$ | 1289 |
| | $\alpha \longleftrightarrow \alpha'$ | −53 |
| Th | $\beta \longleftrightarrow \alpha$ | 1360 |
| Ti | $\beta \longleftrightarrow \alpha$ | 882 |
| Tl | $\beta \longleftrightarrow \alpha$ | 230 |
| U | $\gamma \longleftrightarrow \beta$ | 776 |
| | $\beta \longleftrightarrow \alpha$ | 668 |
| Y | $\beta \longleftrightarrow \alpha$ | 1478 |
| Yb | $\gamma \longleftrightarrow \beta$ | 795 |

TABLE 1-continued

| Allotropic Phase Transformations at 1 atm | | |
|---|---|---|
| Element | Transformation | Temperature (°C.) |
| | $\beta \longleftrightarrow \alpha$ | −3 |
| Zr | $\beta \longleftrightarrow \alpha$ | 863 |

*data from ASM Handbook, Volume 3, ASM International, Materials Park, Ohio, 1992 (Appendix 4.7).

TABLE 2

| Pressure-Induced Allotropic Phase Transformations at 25° C. | |
|---|---|
| Element | Pressure (GPa) |
| βAl | >20.5 |
| δAm | >15 |
| βBa | >5.33 |
| γBa | >23 |
| BeII | >28.3 |
| βBi | >2.6 |
| γBi | >3.0 |
| δBi | >4.3 |
| Bi | >9.0 |
| C (diamond) | >60 |
| γCa | >1.5 |
| α'Ce | >5.4 |
| βCs | >2.37 |
| β'Cs | >4.22 |
| γCs | >4.27 |
| γDy | >7.5 |
| εFe | >13 |
| βGa | >1.2 |
| γGa | >3.0 |
| γGd | >3.0 |
| βGd | >12 |
| βGe | >12 |
| γGe | >12 |
| He | 0.163(T = −269.67° C.) |
| $He^4$ | 0.129(T = −269.2° C.) |
| βHo | >7.5 |
| β'La | >2.0 |
| γN | >3.3(at T < 253° C.) |
| γNd | >5.0 |
| βPb | >10.3 |
| γPr | >4.0 |
| βRb | >1.08 |
| γRb | >2.05 |
| βSb | >5.0 |
| γSb | >7.5 |
| δSb | >14.0 |
| βSi | >9.5 |
| γSi | >16.0 |
| δSi | >16 |
| δSm | >4.0 |
| γSn | >9.0 |
| β'Sr | >3.5 |
| γTb | >6.0 |
| βTe | >2.0 |
| γTe | >7.0 |

*data from ASM Handbook, Volume 3, ASM International, Materials Park, Ohio, 1992 (Appendix 4.11).

TABLE 3

| Phase Transformations of Selected Ceramic and Ionic Materials | | |
|---|---|---|
| Material | Transformation | Temperature (K) |
| $As_2O_3$ | $\alpha \longleftrightarrow \beta$ | 503 |
| $Fe_2O_3$ | $\alpha \longleftrightarrow \beta$ | 53 |
| $Mn_3O_4$ | $\alpha \longleftrightarrow \beta$ | 1445 |
| PbO | $\alpha \longleftrightarrow \beta$ | 813 |
| $SiO_2$ | $\alpha \longleftrightarrow \beta$ | 856 |
| TiO | $\alpha \longleftrightarrow \beta$ | 1264 |
| $Ti_2O_3$ | $\alpha \longleftrightarrow \beta$ | 473 |
| $VO_2$ | $\alpha \longleftrightarrow \beta$ | 345 |
| $ZrO_2$ | $\alpha \longleftrightarrow \beta$ | 1478 |
| | $\beta \longleftrightarrow \gamma$ | −2650 |
| AgI | $\alpha \longleftrightarrow \beta$ | 419 |
| $CuS_2$ | $\alpha \longleftrightarrow \beta$ | 376 |

TABLE 3-continued

| Phase Transformations of Selected Ceramic and Ionic Materials | | |
|---|---|---|
| Material | Transformation | Temperature (K) |
| $Bi_2O_3$ | $\alpha \longleftrightarrow \beta$ | 1003 |

The first transforming phase can be bonded to the non-transforming phase which means that the transforming phase does not become delaminated from the non-transforming phase on undergoing a phase transformation, so that during step (2) of cycling the transforming phase through its phase transformation, internal stress will be created in the composite as the change in the transforming phase, as already described, must be accommodated by the matrix which remains bonded to the transforming phase. The non-transforming phase can be chemically compatible with the transforming phase so that it does not react so rapidly with the transforming phase to be consumed by the reaction. The non-transforming phase can also deform plastically in response to changes in the transforming phase during phase transformation.

In step (2) of cycling the composite material through the phase transformation of the first transforming phase, additional steps of adjusting thermodynamic conditions so that the first transforming phase undergoes the phase transformation and maintaining the thermodynamic conditions for a sufficient time to allow the necessary portion of the first transforming phase to undergo a phase transformation so that when an external stress is applied according to step (3), superplastic deformation will be induced in the composite material. The step of adjusting thermodynamic conditions so the first transforming phase undergoes a desired phase transformation can be repeated multiple times so that large deformations, as required for a particular process, can be achieved as a superplastic deformation is incrementally increased with each cycle so that the overall composite material is not prematurely ruptured by the stresses created during the phase transformation of the transforming phase or by nucleation and growth of voids. When temperature is the thermodynamic condition varied, the heating rate can be as rapid as possible to allow the material to be cycled as quickly as possible. Temperature excursions both above and below the phase transformation temperature can be minimized, also to allow for rapid cycling. An inert atmosphere can be provided if the material is sensitive to air.

The external stress that is applied to the composite material can be a hydrostatic or non-hydrostatic stress such as a uniaxial or multiaxial stress. Appropriate non-hydrostatic stresses for use according to the method of the invention are tensile, compressive, torsional and bending stresses. These stresses can be applied by exerting mechanical pressure or fluid pressure on the composite material. Mechanical pressure can be exerted by using a ram for pushing, pulling, or bending the composite material. Fluid pressure can be exerted by a gas or liquid.

According to the invention, a method for forming a part includes steps of providing a composite material having a non-transforming phase and a transforming phase, cycling the composite material through a phase transformation of the first transforming phase and shaping the composite material by applying an external stress to the composite material before and/or during and/or after the first transforming phase is undergoing a phase transformation to result in production of a finished part. This method for forming a part can be used for a wide variety of composite materials including metal matrix composites, intermetallic matrix composites, ionic matrix composites, ceramic matrix composites, and polymer matrix composites such as the specific composite materials already described.

As already described, the first transforming phase undergoes a phase transformation such as the phase transformations already described resulting in a change in a physical characteristic of the transforming phase. The transforming phase can be a metal, alloy, ceramic, polymer, ionic or covalent material, such as the examples which have already been provided.

The composite material can include a plurality of transforming phases and the method for forming a part then includes additional steps of cycling one or more of the plurality of transforming phases through its phase transformation. The phase transformation can be accomplished by varying any phase transformation-inducing thermodynamic variable appropriate to induce the particular phase transformation desired. As already described in detail, the composite material can be selected to have a volume fraction of the first transforming phase chosen so that its subsequent phase transformation can be accommodated by the non-transforming phase without causing degradation in the mechanical properties of the composite material or rupture of the composite material.

In a preferred embodiment, the composite material is cycled through the phase transformation by cycling temperature around a phase transformation of the transforming phase. Temperature can be varied so that the first transforming phase undergoes the phase transformation and the composite material can be held at the phase transformation temperature until a sufficient proportion of the first transforming phase has undergone the phase transformation so that when an external stress is applied to the composite material, superplastic deformation is induced in the composite. The external stress can be a hydrostatic or a non-hydrostatic stress which can be any material forming or shaping process which involves a flow of the composite material being formed such as drawing, stamping, extruding, rolling, pulling, bending or twisting processes of a magnitude appropriate to shape the composite material to form the finished part.

A method for inducing superplasticity in a Ti/TiC composite is provided which includes selecting a Ti/TiC material having a TiC non-transforming phase and a titanium transforming phase; thermally cycling the titanium transforming phase through a phase transformation of titanium and applying an external stress to the Ti/TiC composite material so that superplastic deformation is induced in the Ti/TiC composite.

In a preferred embodiment, the Ti/TiC composite material is selected to have the titanium transforming phase present in an amount in the range of from about 99 vol % to about 1 vol %, more preferably in the range of from about 95 vol % to about 10 vol %, and most preferably in the range of from about 90 vol % to about 60 vol %. The titanium transforming phase can be thermally cycled through a phase transformation by heating the Ti/TiC composite material between a lower temperature and an upper temperature, so that the transformation temperature (or transformation temperature range) is between the lower and upper temperatures in the range of from about 850° C. to about 1050° C., more preferably in the range of from about 860° C. to about 900° C., and most preferably in the range of from about 880° C. to about 884° C. in a time period in the range of from about 1 second to about 5 hours, more preferably in the range of from about 10 seconds to about 1 hour, and most preferably in the range of from about 30 seconds to about 5 minutes and holding the composite material at or in a range near the phase transformation temperature until a desired amount of the first titanium transforming phase in the range of from about 1 vol % to about 100 vol % more preferably in the range of from about 10 vol % to about 100 vol %, and most preferably in the range of from about 50 vol % to about 100 vol % has undergone the phase transformation. Over the already-described temperature range of from about 850° C. to about 1050° C., titanium undergoes a $\beta \rightleftarrows \alpha$ phase transition which results in a change in volume which causes internal stresses which are increased further by the presence of the non-transforming TiC phase, thereby enhancing the superplastic deformation of the Ti/TiC composite.

In order to further illustrate the present invention, the following example is provided. The particular compounds, processes and conditions utilized in the example are meant to be illustrative of the present invention and not limiting thereto.

EXAMPLE 1

The following example is provided to show how superplasticity is induced in a Ti/TiC composite and to compare this behavior to that of unreinforced, bulk Ti metal.

An experimental study was carried out on powder-metallurgy-prepared, commercially-pure, titanium (Ti) and on powder-metallurgy-prepared titanium/titanium-carbide composites (Ti—TiC). Tensile creep strain rate was measured at 1000° C. for stresses between 0.47 MPa and 3 MPa. The strain was found to be slower than when the same type samples were thermally cycled between 830° C. and 1010° C. Isothermally-deformed samples were also more stress-sensitive: the stress exponent value was 2.1 for Ti—TiC with rupture at low strain, while the stress exponent was 4.32 for Ti.

Creep samples were subjected to tensile stresses between 0.18 MPa and 1.7 MPa while undergoing thermal cycling through the $\alpha \longleftrightarrow \beta$ transformation temperature. All samples exhibited transformation plasticity, and deformed up to 1.5% during each cycle, without necking. After repeated cycling through the phase transition temperature, samples deformed as much as 150%. The relationship between the strain rate per cycle, $\Delta\epsilon_{tr}$, and the stress, $\Delta\sigma$, was determined to be linear ($\Delta\epsilon_{tr}/\Delta\sigma = 5\times10^{-9}$ Pa$^{-1}$ and $8\times10^{-9}$ Pa$^{-1}$ for Ti—TiC). The composite deformed to a greater extent during each thermal cycle than the unreinforced matrix.

Extruded titanium rod of 99.99% purity was procured from Johnson-Matthey, (Ward Hill, Mass.).

Commercially pure titanium powders with extra-low chlorine, and 10 volume percent titanium carbide particles were formed into rod-shaped billets by cold isostatic pressing. These billets were then canned and hot isostatically pressed (HIP) for 240 minutes at 1185° C. and 172.4 MPa to form composite billets with densities of 96% and above. Powders were produced by Dynamet, Inc. (Burlington, Mass.).

To provide a control medium for comparison to the composite behavior, commercially pure titanium powders with extra-low chlorine were prepared similarly to the above composite by Dynamet, Inc. (Burlington, Mass.). This material was HIPed for 120 minutes at 899° C. and 103.4 MPa resulting in densities above 95%.

The as-received billets were cut and polished to determine the initial microstructure of the Ti and Ti—TiC samples. Cutting was done a Buehler low-speed saw using Buehler isocut fluid (11-1193-032), and a Struers diamond blade (RS-70323). Samples were mounted in Struers 24 Hour Epoxy.

Rough polishing was done on a Abropol-2 automatic polisher starting with 320 grit SiC paper and finishing with 800 grit. Final polishing was done starting with 4000 grit SiC paper, moving to 0.3 micron alumina powder suspended in distilled water, and finishing with 0.05 micron alumina powder suspended in distilled water. Polishing wheels were flushed with water during all stages of polishing. All samples were rinsed in distilled water before continuing to the next polishing stage.

Samples were etched with a modified Kroll's reagent of 25 volume percent (vol %) $H_2NO_3$, 25 vol % HF, and 50 vol % distilled water. Ti samples etched well with 5 repetitions of a one second swab. Ti—TiC samples showed some microstructure after 15 repetitions of the one second swab.

Grain size was determined by a linear scale method. A 100 μm scale with 5 μm intervals was placed over micrographs and the lengths of the grains it crossed were measured. Five random orientations and positions were used to collect length data. The data were then averaged to give grain size.

All test samples were machined from rod or rod-shaped billet by Dirats Laboratory, (Westfield, Mass.). Dilatometer samples were parallelopiped-shaped: 45 to 50 mm long and 4 mm square in cross-section. Creep samples had a diameter of 6 mm and a gauge length of 30 mm. Tensile specimens had a diameter of 66 mm and a gauge length of 20 mm. All samples were tested in the as-received state.

Room temperature tensile tests were carried out on Ti and Ti—TiC using an Instron 4506 screw-driven machine. Tests were conducted with a constant crosshead speed of 0.5 mm/min. An extensometer with a 12.7 mm gauge length was attached to the sample with rubber bands. The maximum load cell capacity was 150,000N. Data acquisition was done with a Hewlett Packard computer.

All creep experiments were carried out in a Centorr Vacuum Industries (model M60-3×8-M-02M-2-A-20) vacuum creep furnace. Rough vacuum pumping was done with a Duo Seal vacuum pump (model 1402). High vacuum was achieved suing a Varian diffusion pump (model 0160). Vacuum levels were measured with a Varian ion gauge. The creep furnace chamber was modified to allow heating under an inert atmosphere instead of a vacuum. Cover gas used was argon with 4 ppm contaminating gases (including 1 ppm of $O_2$), or argon with 10 ppm contaminating gases (including 4ppm $O_2$). The latter gas was run through a Matheson gas purifier (model 6406) which reduced oxygen content to 0.5 ppm of $O_2$. A Nupro pressure release valve (1 psi) was used to control pressure in the chamber. All connections were made with copper tubing and swage compression fittings.

The temperature was controlled with a Research Incorporated (model 5310) Data Trak card reader. Sample temperature was measured using Omega K-type thermocouples covered with woven heat resistant fabric (part number XC-24-K-12). Thermocouples were connected to external extension wires by Omega high temperature ceramic connectors (part number NOX-K-MF). Temperature was read on an Omega digital thermometer (model 2168A). A record of the temperature was kept with an Omega RD 6112 plotter.

Linear crosshead displacement was measured using Schaevitz Engineering Linear Voltage Displacement Transducers (LVDT) type 200-DC-D. The LVDT measurements were recorded using a Gould Chart Recorder (model 110).

All samples were subjected to thermal cycling through the transformation temperature as determined by DSC tests. The heating and cooling rates were 85 K/min. Samples were held at the upper and lower temperatures for four minutes during each cycle to ensure complete transformation and stabilization of the thermal expansion. Total cycle time was 12 minutes. To protect the samples and tungsten furnace from contamination, 12 $cm^2$ zirconium foil was used as a getter.

a. Cycling without load: Parallelopiped-shaped dilatometer samples were suspended with a steel wire isolated from the samples by two small caps of titanium foil. These samples underwent the thermal cycling at the same time as the loaded samples. Each time the furnace was opened, the samples were removed, observed, and their linear dimensions measured.

b. Cycling under load: Creep samples were suspended between the holders in the load train and subjected to small loads (from 0.5 to 2 MPa). The load train magnification was 11. Preliminary tests showed that the creep in a sample could vary significantly from the beginning of a thermal cycling test to the end. To avoid this problem, samples were first deformed at the higher hold temperature until the strain rate was constant for at least the duration of a complete thermal cycle (12 minutes). After at least 10 readable, and error free cycles were complete, the load on the sample was increased. The sample was allowed to reach a steady state creep at the higher temperature, and then the thermal cycling was started again. Each sample was subjected to up to 5 tests.

Using the above-described apparatus, Ti and Ti—TiC samples were tested in uniaxial tension at a constant temperature of 1000° C. The chamber was heated to temperature with the sample under a very small load (0.1 MPa). After the temperature was stable, the sample was loaded with the test load. The sample was allowed to creep until it reached a steady state creep rate ($\Delta\epsilon/\Delta t$ =constant). The sample was then subjected to a higher stress load, and again allowed to reach steady state. This pattern was repeated on each sample until the sample failed, or the total possible crosshead displacement was exhausted. All experiments started at small loads which were monotonically increased.

Figure 2:
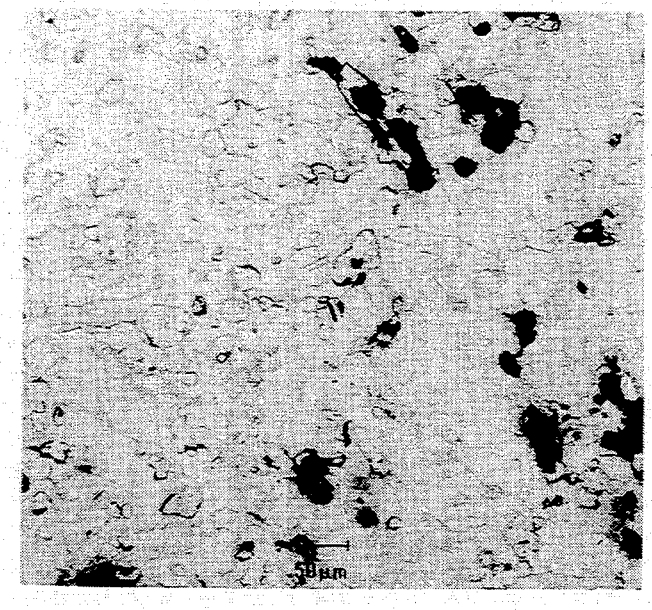
FIG. 2 is an optical micrograph showing the microstructure of a Ti/TiC composite sample before processing according to the method of the invention.
Figure 3:
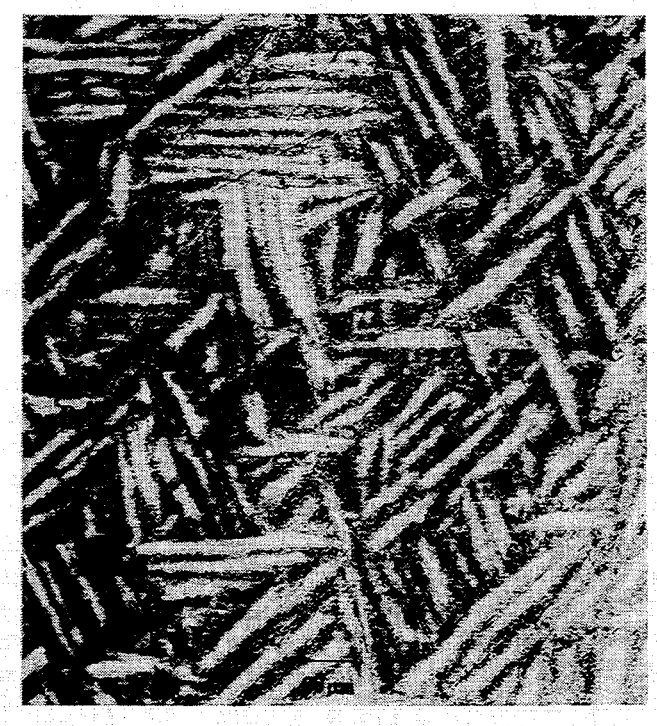
FIG. 3 is an optical micrograph showing the microstructure of a Ti sample after undergoing thirty cycles from 830° C. to 1010° C.
Figure 4:
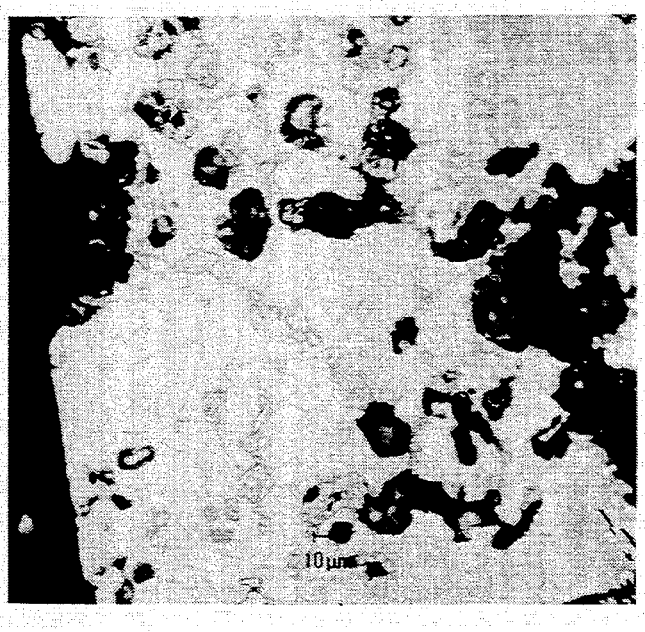
FIG. 4 is an optical micrograph showing the microstructure of a Ti/TiC composite sample after undergoing thirty cycles from 830° C. to 1010° C.
Figure 5:
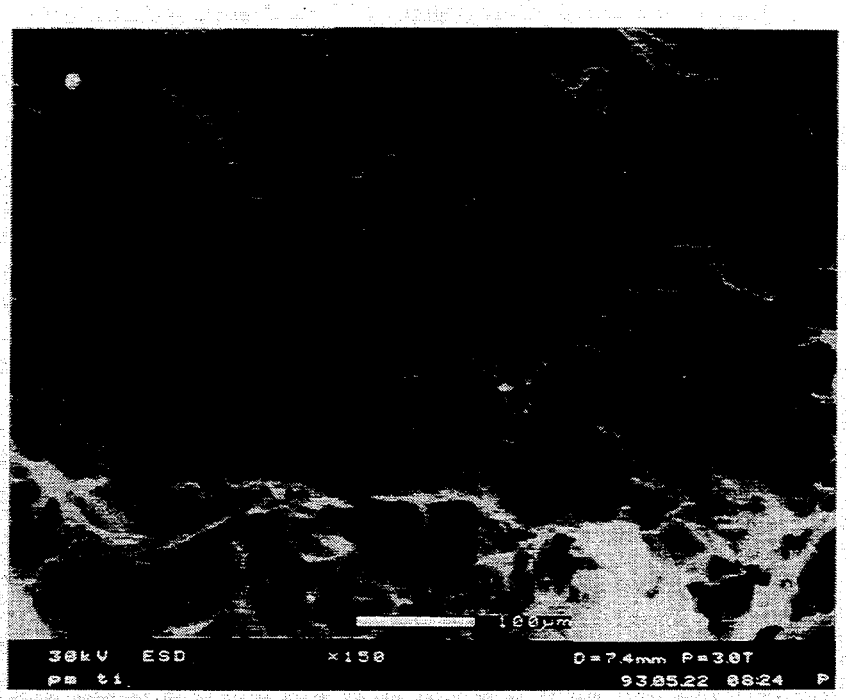
FIG. 5 is a SEM micrograph at low magnification showing a Ti tensile fracture surface.
Figure 6:
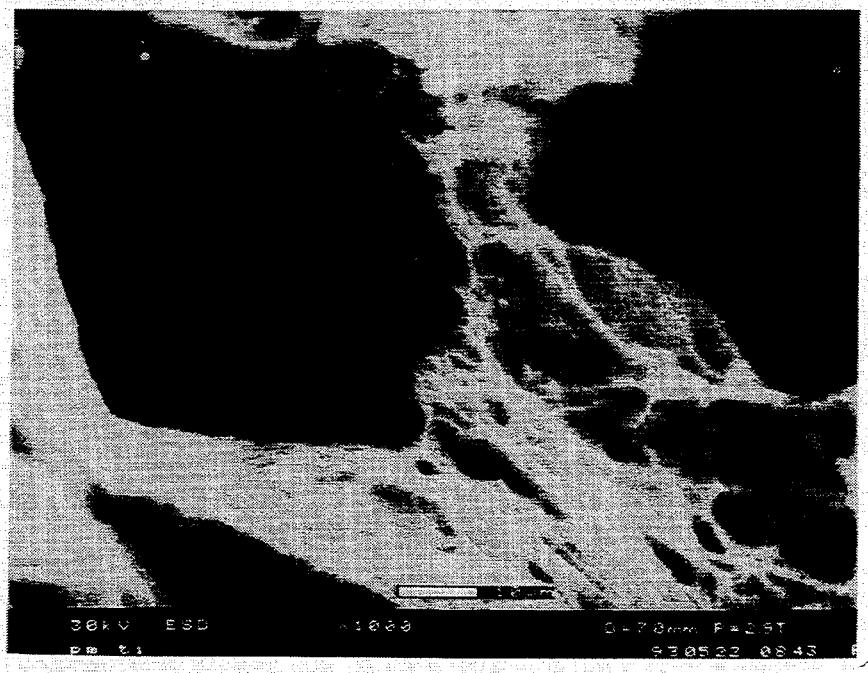
FIG. 6 is a SEM micrograph at high magnification showing a Ti tensile fracture surface.
Figure 7:
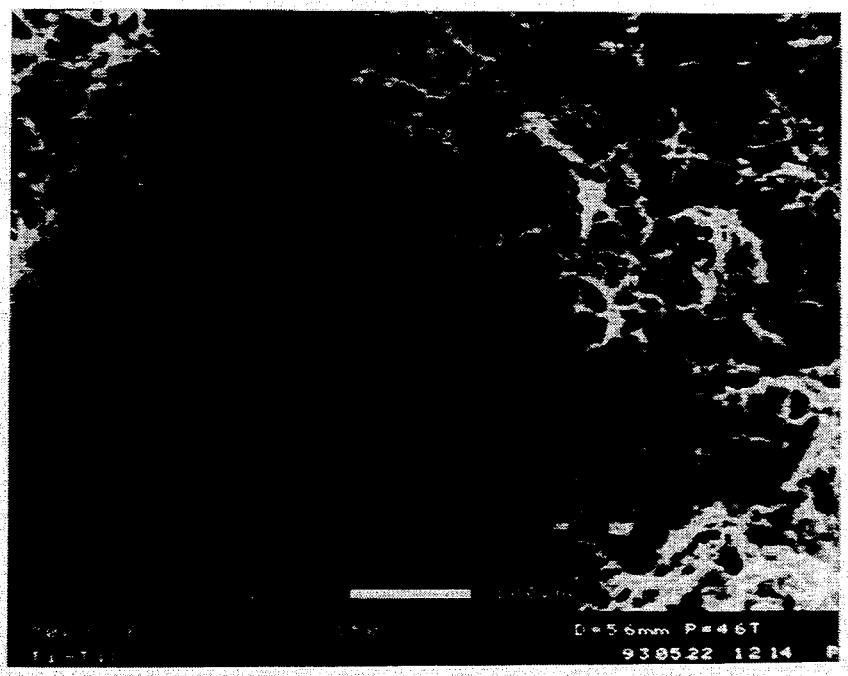
FIG. 7 is a SEM micrograph at low magnification showing a Ti/TiC tensile fracture surface.
Figure 8:
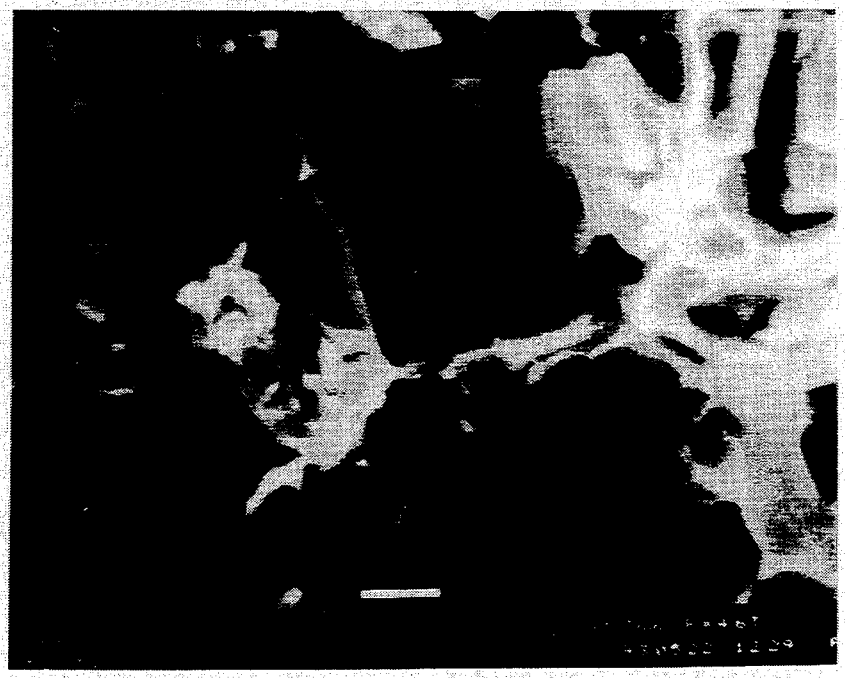
FIG. 8 is a SEM micrograph at high magnification showing a Ti/TiC composite tensile fracture surface.
Figure 9:
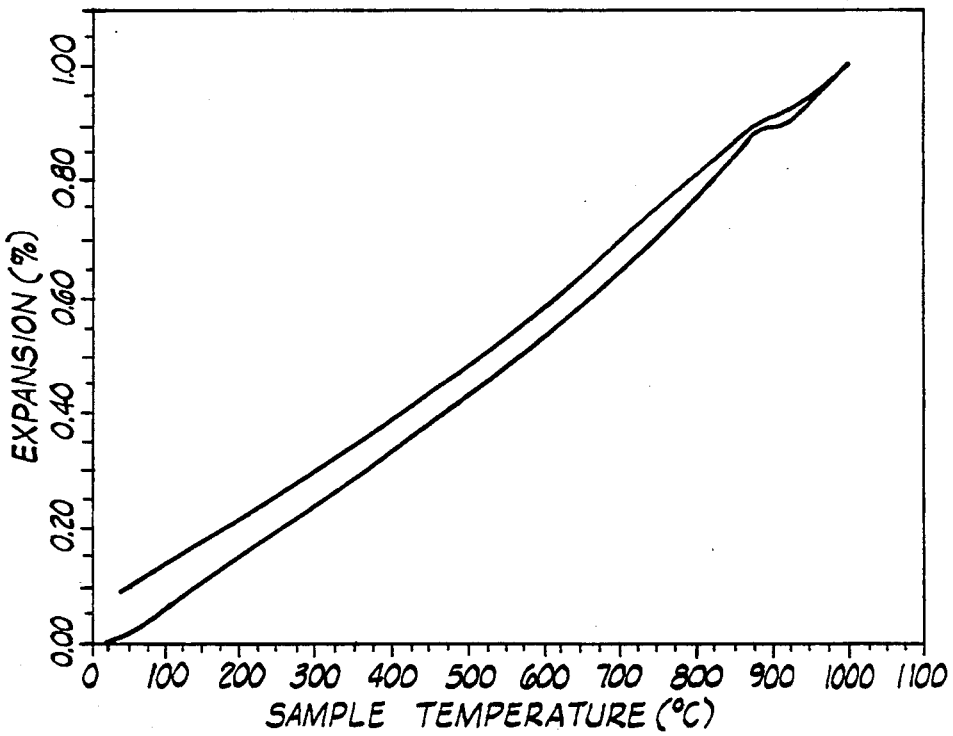
FIG. 9 is a graph showing expansion as a function of temperature and representing a thermal expansion curve for a Ti sample.
Figure 10:
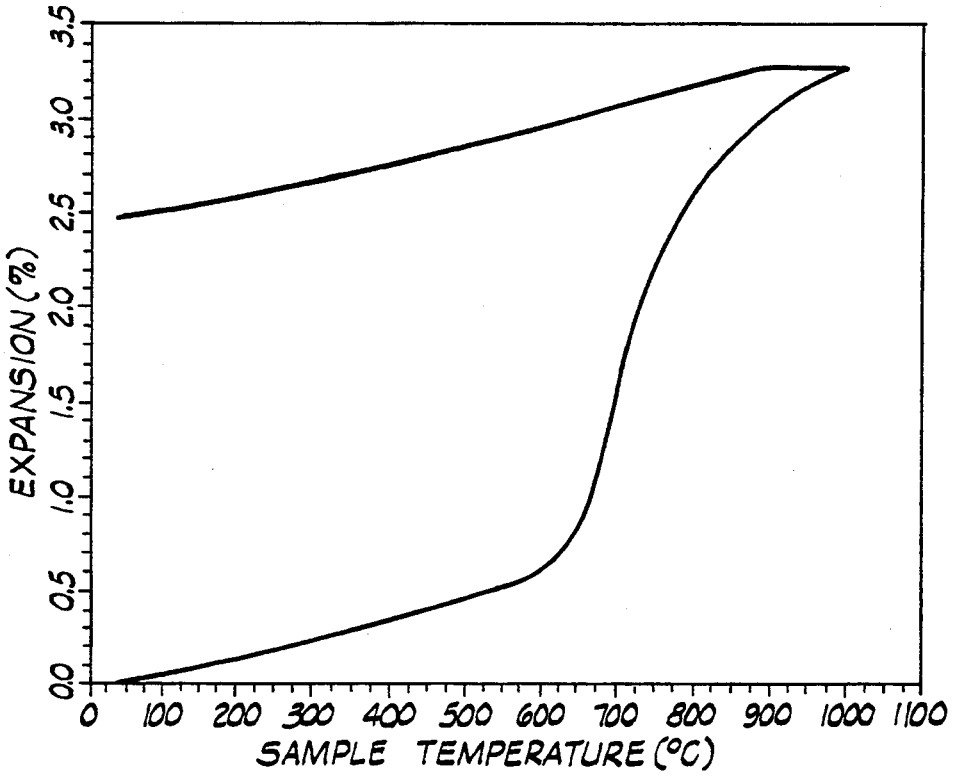
FIG. 10 is a graph of expansion as a function of temperature representing a thermal expansion curve for a Ti/TiC composite sample.

FIGS. 1 and 2 show the microstructure of the untested Ti and Ti—TiC billets, respectively. FIGS. 3 and 4 show how the microstructures have changed after thirty cycles from 830° C. to 1010° C. The grain size of the Ti was measured to be 50 μm before and after thermal cycling. The grain size in the Ti—TiC was 20 μm before cycling and was 10 μm after cycling. The TiC particles are well dispersed, and porous, with average size of 45 μm. The particles are angular and show large size variations. FIGS. 5 and 6 show different magnifications of the fracture surface of a Ti sample that failed during a room temperature tensile test. FIGS. 7 and 8 show two different magnifications of a Ti—TiC fracture surface from a sample fractured under the same conditions.

TABLE 4

| Mechanical Properties of Ti and Ti—TiC From Room Temperature Tensile Tests | | |
|---|---|---|
| Property | Ti | Ti—TiC |
| E (GPa) | 109 | 121 |
| UTS (MPa) | 430 | 430 |
| $\sigma_y$ (MPa) | 300 | 375 |
| Strain to failure (%) | 4.7 | 2.3 |

Figure 11:
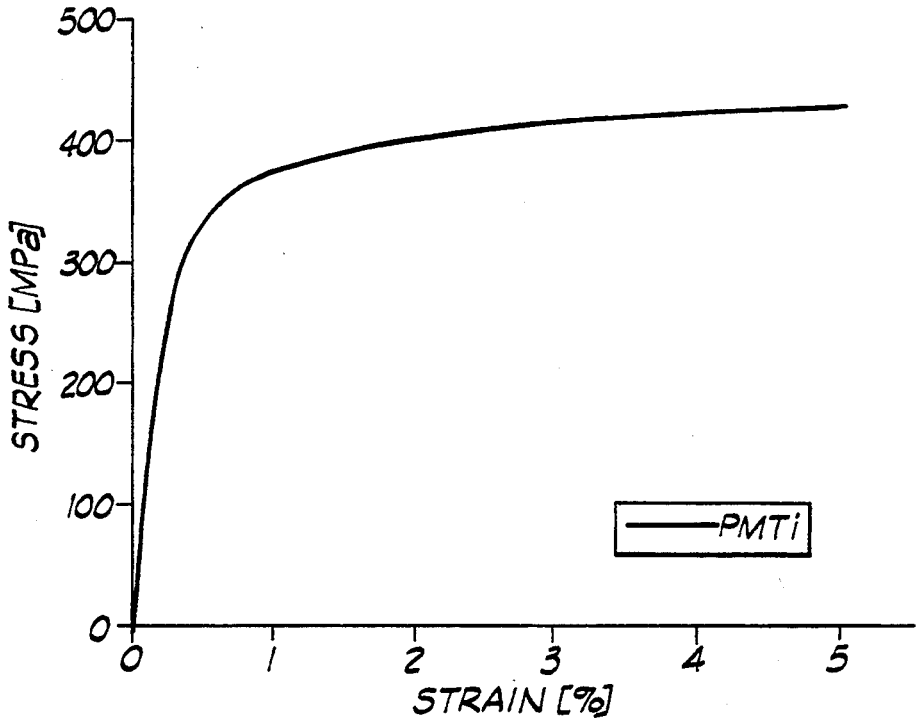
FIG. 11 is a graph showing stress as a function of strain and representing a room temperature tensile test curve of engineering stress versus engineering strain for a Ti sample.
Figure 12:
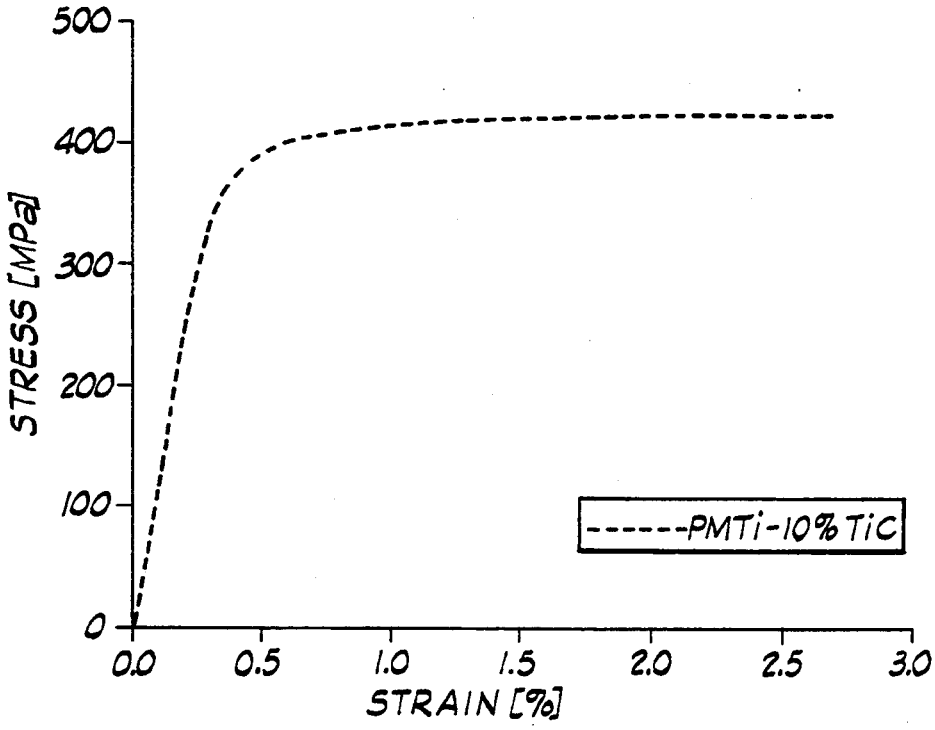
FIG. 12 is a graph showing stress as a function of strain and representing a room temperature tensile test curve of engineering stress versus engineering strain for a Ti/TiC composite sample.

FIGS. 11 and 12 show the room temperature tensile test curves of engineering stress versus engineering strain for Ti and Ti—TiC, respectively. Table 4 lists the mechanical properties of these two materials, based on these tests. Yield stress was determined at 0.1% plastic strain.

Figure 13:
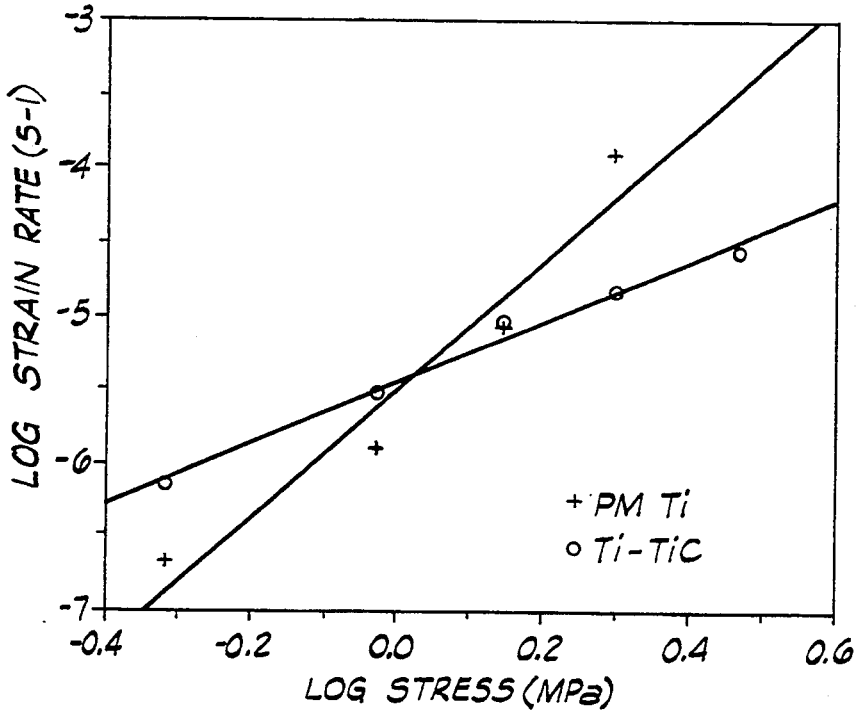
FIG. 13 is a plot of strain rate versus stress for both a Ti and Ti/TiC composite sample at 1000° C. comparing isothermal creep of Ti with that of a Ti/TiC composite.

FIG. 13 shows the relationship between strain rate and stress during steady state creep for the Pm—Ti which refers to bulk Ti metal as distinguished from a Ti—TiC composite and Ti—TiC samples at 1000° C. The stress exponent, n, was 4.32 for the Ti and was 2.2 for the Ti—TiC. Rupture occurred at a stress of 2.96 MPa in the Ti—TiC composite after an engineering strain of only 30%.

Table 5 shows the sample length as a function of the number of cycles for the Ti and the Ti—TiC samples when thermally cycled without a load. After a significant deformation on the first cycle, the Ti—TiC deforms similarly to the Ti.

TABLE 5

| Change in Length for Samples Thermally Cycled Without a Load | | | | |
|---|---|---|---|---|
| # of cycles | length in mm Ti (1) | length in mm Ti (2) | length in mm Ti—TiC (1) | length in mm Ti—TiC (2) |
| 0 | 46.922 | 46.933 | 46.811 | 47.051 |
| 1 | 46.972 | 46.955 | 47.233 | 47.238 |
| 23 | 46.981 | | 47.301 | |
| 49 | | 46.962 | | 47.246 |
| 78 | 46.992 | | 47.310 | |

Figure 14:
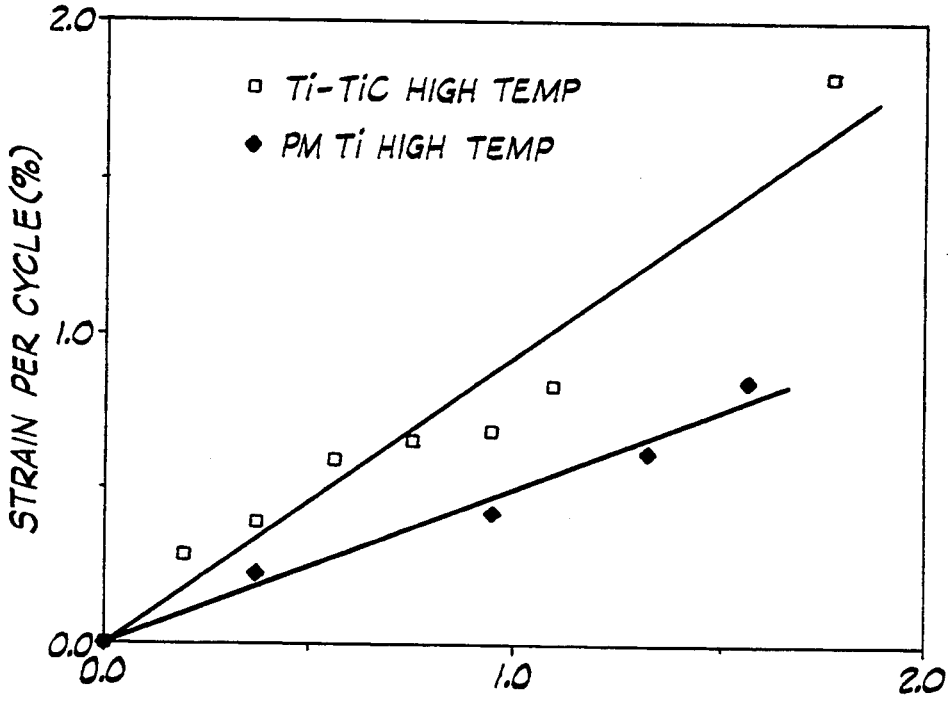
FIG. 14 is a plot showing transformation strain versus stress for a Ti and a Ti/TiC composite sample cycled from 830° C. to 1010° C. and comparing deformation due to thermal cycling.
Figure 15:
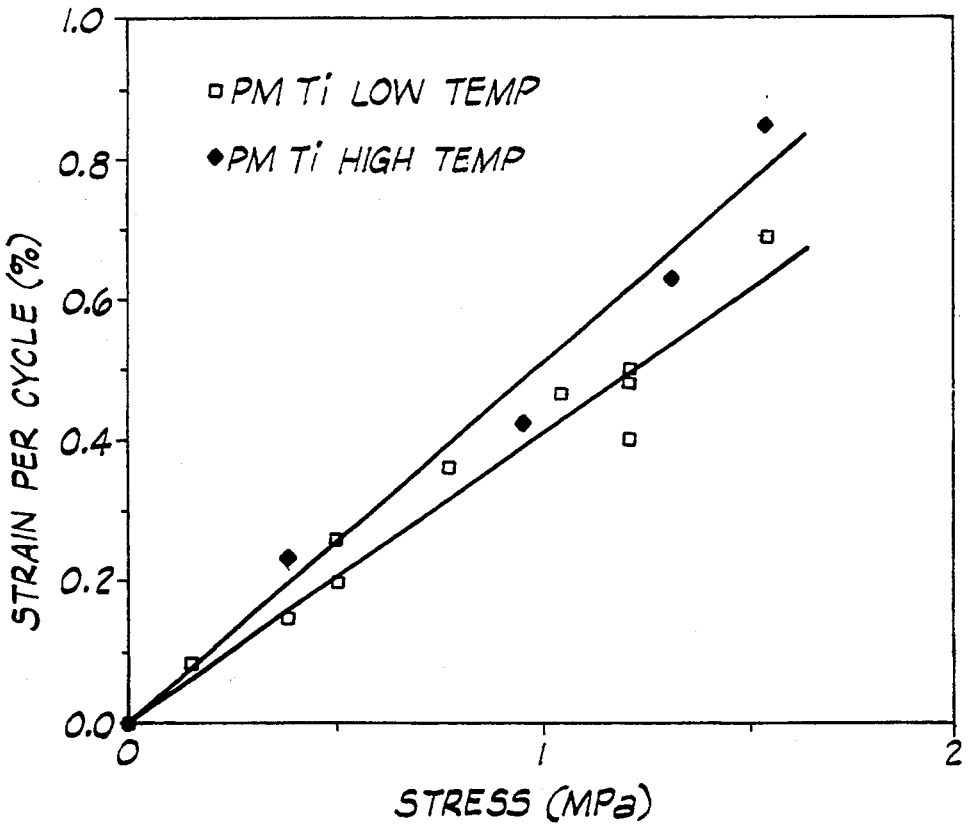
FIG. 15 is a plot of transformation strain versus stress for a Ti sample cycled from 830° C. to 960° C. (low T) and from 830° C. to 1010° C. (high T) comparing deformation due to high temperature and low temperature cycling.

FIG. 14 shows the average strain per cycle due to thermal cycling of the Ti and the Ti—TiC with temperature cycling between 830° C. and 1010° C. A total of at least 10 readable and error-free cycles were averaged to determine the strain due to thermal cycling at a given stress. The comparison of Ti cycled between 830° C. and 1010° C., or cycled from 830° C. to 960° C. is shown in FIG. 15. The same comparison is shown for Ti—TiC in FIG. 16.

Figure 16:
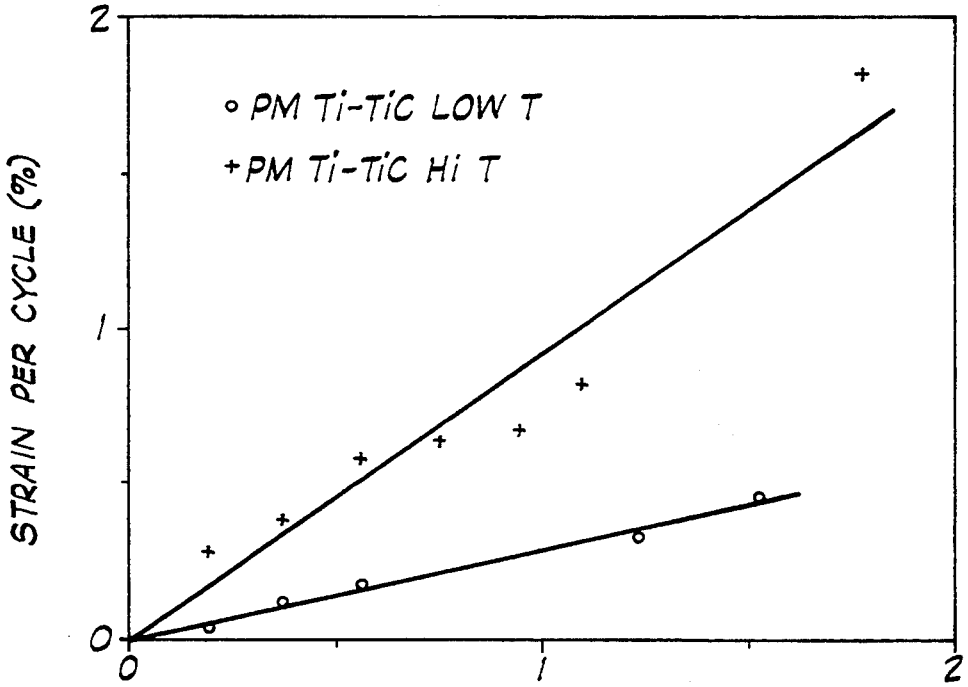
FIG. 16 is a plot of transformation strain versus stress for a Ti/TiC composite sample cycled from 830° C. to 960° C. (low T) and cycled from 830° C. to 1010° C. (high T) and showing composite deformation for complete and partial transformation.

There is a significant difference between the deformation per thermal cycle in the Ti—TiC and the Ti, as seen in FIG. 16. In both cases, $\Delta\epsilon_{tr}/\Delta\sigma$ is linear. However, for the Ti, $\Delta\epsilon_{tr}/\Delta\sigma=5\times10^{-9}$ Pa$^{-1}$, and for the Ti—TiC, $\Delta\epsilon_{tr}/\Delta\nu=8\times10^{-9}$ Pa$^{-1}$. This increased strain per cycle is a new effect due to the internal stresses induced by the hard particles in the transforming matrix.

The equivalent strain rate, $\Delta\epsilon/\Delta t$, per cycle is $1.1\times10^{-6}$ sec$^{-1}$ for Ti—TiC at a stress of 1 MPa. This rate was calculated by taking the strain due to the transformation through a complete cycle, and dividing that strain by the time to complete a cycle. If instead, the actual time to heat and cool, 4 min, was used $\Delta\epsilon/\Delta t$ (at 1 MPa)$=3.33\times10^{-5}$ sec$^{-1}$. This rate is higher that the isothermal strain rate $\dot{\epsilon}=3.16\times10^{-6}$ sec$^{-1}$. This rate could be even faster, with good heat transfer, and rapid transformation kinetics. This rapid strain rate occurs each cycle without necking, or macroscopic damage to the deforming specimen.

In FIG. 16 there is virtually no difference between the low temperature cycling and the high temperature cycling. Both temperatures are high enough for the Ti to fully transform. To ensure that the creep rate active during the cycling was accounted for, each sample was allowed to creep prior to and after the cycling test at the given stress. Furthermore, the material was tested to determine if the matrix "reset" after a phase transformation. Since primary creep would induce an error in the determination of isothermal creep during the cycling, tests were run to ascertain that no primary creep occurred in the $\beta$ phase upon phase transformation. The tests were as follows: unloading, allowing the sample to transform and then reloading. Comparison of the resulting creep curves after sufficient pre-creep, showed that the creep rates before and after the transformation were the same, with no primary creep.

None of the cycled samples failed, necked or exhibited the rough surface found in the isothermal creep samples. The maximum strain measured was 150%. The combination of (i) large strains in tension, (ii) proportionality between stress and strain or strain rate, and (iii) unchanged structure after deformation, are typically associated with superplasticity.

If the heating stops before the transformation is complete, superplastic deformation due to the transformation is reduced. Since the Ti—TiC did not undergo complete transformation when heated only to 960° C. due to oxygen contamination, the internal stresses were reduced, with a concomitant reduced strain per cycle.

When deformed under cycling conditions, the composite reaches elongations of at least 150%, compared to elongations of 30% prior to rupture for the isothermal creep tests. The creep rate is also higher, for thermal cycling creep. With rapid heating or cooling across the phase transformation temperature, superplastic forming of Ti—TiC composites may be possible at strain rates much higher than for fine-grain, superplastic composites.

What is claimed is:

1. A method for inducing superplasticity in a composite comprising:

(1) providing a composite material having a first non-transforming phase and characterized by a first composition and a first transforming phase characterized by a second composition different from said first composition and not including said first composition as a solution constituent of said second composition;

(2) cycling said composite material through a phase transformation of said first transforming phase; and (3) applying an external stress to said composite material so that superplastic deformation is induced in said composite whereby transformation strain produced in said composite material is greater than transformation strain which would be produced in said transforming phase along after performing steps (2) and (3).

2. The method of claim 1 wherein in step (1) of providing a composite material said composite material is selected from the group consisting of a metal matrix composite, a ceramic matrix composite, a polymer matrix composite, a covalent matrix composite, an ionic matrix composite and an intermetallic matrix composite.

3. The method of claim 2 wherein said composite material is a metal matrix composite selected from the group consisting of $Cu/Bi_2O_3$, $Ti/TiB_2$, $U/ThO_2$, Co/WC, $Sn/Al_2O_3$, Ti/TiC, Fe/TiC, and $Zr/ZrO_2$.

4. The method of claim 3 wherein said metal matrix composite material further includes a metal matrix and wherein said metal matrix undergoes said phase transformation.

5. The method of claim 2 wherein said composite material is an intermetallic matrix composite selected from the group consisting of $GaMn/ZrO_2$, NiTi/TiC and $Cr_5Ge_3/Y_2O_3$.

6. The method of claim 2 wherein said composite material is a ceramic matrix composite selected from the group consisting of $ZrO_2/Y_2O_3$, $Bi_2O_3/Al_2O_3$, $SiO_2/TiB_2$ and SiC/TiC.

7. The method of claim 2 wherein said composite material is an ionic matrix composite selected from the group consisting of $AgI/Al_2O_3$ and $CuS_2/TiC$.

8. The method of claim 2 wherein said composite material is selected from the group consisting of SiC/TiC, C/TiC and $Si/SiO_2$.

9. The method of claim 1 wherein said first transforming phase is a material which undergoes a solid-solid phase transformation which results in a change in a first transforming phase physical characteristic selected from the group consisting of volume, crystal lattice structure, shape and orientation of said first transforming phase.

10. The method of claim 9 wherein said solid-solid phase transformation is selected from the group consisting of allotropic, martensitic, eutectoid and peritectoid phase transformations.

11. The method of claim 9 wherein said first transforming phase is an element selected from the group consisting of titanium, iron, zirconium, cobalt, uranium, tin, ytterbium, manganese, sulfur, sodium and nitrogen.

12. The method of claim 9 wherein said first transforming phase is an alloy selected from the group consisting of $Cr_5Ge_3$, NiTi, Ti98-Al2, Fe99.95-C0.05, Zr50-Ti50 and Ga-Mn.

13. The method of claim 9 wherein said first transforming phase is a ceramic material selected from the group consisting of zirconia, bismuth oxide, quartz, lead oxide, $As_2O_3$, $Fe_2O_3$, $Mn_3O_4$, TiO, $Ti_2O_3$, SiC and vanadium oxide.

14. The method of claim 9 wherein said first transforming phase is an ionic material selected from the group consisting of AgI and $CuS_2$.

15. The method of claim 1 wherein said first transforming phase is a covalent material selected from the group consisting of SiC, carbon and silicon.

16. The method of claim 1 wherein said composite material comprises a plurality of transforming phases, and step (2) further comprises additional steps of cycling at least one of said plurality of transforming phases through a phase transformation.

17. The method of claim 1 wherein step (1) comprises selecting a composite material containing a volume fraction of said first transforming phase such that the mechanical properties of said non-transforming phase can accommodate the phase transformation of said first transforming phase while maintaining the integrity of said composite.

18. The method of claim 1 wherein step (2) of cycling said composite material through said phase transformation is accomplished by varying a phase transformation-inducing thermodynamic variable selected from the group consisting of temperature, pressure, electric field and magnetic field.

19. The method of claim 1 wherein said first transforming phase is bonded to said first non-transforming phase so that in step (2) said phase transformation causes internal stress in said composite.

20. The method of claim 1 wherein step (2) of cycling said composite material through said phase transformation of said first transforming phase further comprises steps of (2a) adjusting thermodynamic conditions so that said first transforming phase undergoes said phase transformation and (2b) maintaining said thermodynamic conditions so that a sufficient proportion of said first transforming phase undergoes said phase transformation so that upon applying an external stress according to step (3), superplastic deformation is induced in said composite.

21. The method of claim 20 wherein step (2a) is repeated multiple times so that large deformations are reached by adding a superplastic deformation increment after each cycle, while maintaining mechanical integrity of the material.

22. The method of claim 1 wherein said external stress is selected from the group consisting of hydrostatic and non-hydrostatic stresses.

23. A method for inducing superplasticity in a composite comprising:

(1) providing a composite material having a first non-transforming phase and a first transforming phase further characterized by a magnetic phase transition;

(2) cycling said composite material through a phase transformation of said first transforming phase while applying an external magnetic field to said composite material to induce said magnetic phase transition; and (3) applying an external stress to said composite material so that superplastic deformation is induced in said composite.

24. A method for forming a part comprising:

(1) providing a composite material having a first non-transforming phase characterized by a first composition and a first transforming phase characterized by a second composition different from said first composition and not including said first composition as a solution constituent of said second composition;

(2) cycling said composite material through a phase transformation of said first transforming phase; and (3) shaping said composite material by applying an external stress to said composite material so that superplastic deformation is induced in said composite material, thus forming a finished part whereby transformation strain produced in said composite material is greater than transformation strain which would be produced in said transforming phase alone after performing steps (2) and (3).

25. The method of claim 24 wherein in step (1) of providing a composite material, said composite material is selected from the group consisting of a metal matrix composite, a ceramic matrix composite, an ionic matrix composite, a covalent matrix composite, an intermetallic matrix composite and a polymer matrix composite.

26. The method of claim 25 wherein said composite material is a metal matrix composite selected from the group consisting of $Cu/Bi_2O_3$, $Ti/TiB_2$, $U/ThO_2$, Co/WC, $Sn/Al_2O_3$, Ti/TiC, Fe/TiC and $Zr/ZrO_2$.

27. The method of claim 26 wherein said metal matrix composite material further includes a metal matrix and wherein said metal matrix undergoes said phase transformation.

28. The method of claim 25 wherein said composite material is an intermetallic matrix composite selected from the group consisting of $GaMn/ZrO_2$, NiTi/TiC and $Cr_5Ge_3/Y_2O_3$.

29. The method of claim 25 wherein said composite material is a ceramic matrix composite selected from the group consisting of $ZrO_2/Y_2O_3$, $Bi_2O_3/Al_2O_3$, $SiO_2/TiB_2$ and SiC/TiC.

30. The method of claim 25 wherein said composite material is an ionic matrix composite selected from the group consisting of $AgI/Al_2O_3$ and $CuS_2$/TiC.

31. The method of claim 25 wherein said composite material is selected from the group consisting of SiC/TiC, C/TiC, $Si/SiO_2$ composites.

32. The method of claim 24 wherein said first transforming phase is a material which undergoes a solid-solid phase transformation which results in a change in a first transforming phase physical characteristic selected from the group consisting of volume, crystal lattice structure, shape and orientation of said first transforming phase.

33. The method of claim 32 wherein said first transforming phase is an element selected from the group consisting of titanium, iron, zirconium, cobalt, uranium, tin, ytterbium, manganese, sulfur, sodium and nitrogen.

34. The method of claim 32 wherein said first transforming phase is an alloy selected from the group consisting of $CrsGe_5$, NiTi, Ti98-Al2, Fe99.95-C0.05, Zr50-Ti50 and Ga-Mn.

35. The method of claim 32 wherein said first transforming phase is a ceramic material selected from the group consisting of zirconia, bismuth oxide, quartz, lead oxide, $As_2O_3$, $Fe_2O_3$, $Mn_3O_4$, TiO, $Ti_2O_3$, SiC and vanadium oxide.

36. The method of claim 32 wherein said first transforming phase is an ionic material selected from the group consisting of AgI and $CuS_2$.

37. The method of claim 24 wherein said first transforming phase is a covalent material selected from the group consisting of SiC, carbon and silicon.

38. The method of claim 24 wherein said composite material comprises a plurality of transforming phases, and step (2) further comprises additional steps of cycling at least one of said plurality of transforming phases through a phase transformation.

39. The method of claim 24 wherein step (1) comprises selecting a composite material a volume containing a fraction of said first transforming phase such that the mechanical properties of said non-transforming phase can accommodate the phase transformation of said first transforming phase while maintaining the integrity of said composite.

40. The method of claim 24 wherein step (2) of cycling said composite material through said phase transformation of said first transforming phase is accomplished by varying a phase transformation-inducing thermodynamic variable selected from the group consisting of temperature, pressure, electric field and magnetic field.

41. The method of claim 40 wherein step (2) of cycling said composite material through said phase transformation of said first transforming phase is accomplished by cycling temperature around a phase transformation temperature of said first transforming phase.

42. The method of claim 24 wherein said first transforming phase is bonded to said first non-transforming phase so that in step (2) said phase transformation causes internal stress in said composite.

43. The method of claim 24 wherein step (2) of cycling said composite through said phase transformation of said first transforming phase further comprises steps of (2a) varying temperature so that said first transforming phase undergoes said phase transformation and (2b) maintaining said temperature so that a sufficient proportion of said first transforming phase undergoes said phase transformation so that upon applying an external stress according to step (3), superplastic deformation is induced in said composite.

44. The method of claim 24 wherein said external stress is selected from the group consisting of hydrostatic and non-hydrostatic stresses applied as a result of a forming process used to shape said composite material.

45. The method of claim 44 wherein said forming process involves a flow of material being formed and is selected from the group consisting of drawing, stamping, extruding, rolling, pulling, bending and twisting processes.

46. The method of claim 44 wherein the magnitude of said non-hydrostatic stress is selected to result in the deformation required to shape said composite material to form said finished part.

47. A method for inducing superplasticity in a Ti/TiC composite comprising:

(1) providing a Ti/TiC composite material including a first TiC non-transforming phase and a first Ti transforming phase;

(2) thermally cycling said first Ti transforming phase through a Ti phase transformation; and (3) applying an external stress to said Ti/TiC composite material so that superplastic deformation is induced in said Ti/TiC composite during each cycle of step (2).

48. The method of claim 47 wherein in step (1) of providing said Ti/TiC composite material, said first Ti transforming phase is present in an amount in the range of from about 99 vol % to about 1 vol %.

49. The method of claim 47 wherein said step (2) of thermally cycling said first Ti transforming phase through a phase transformation is accomplished by heating said Ti/TiC composite material to a phase transformation temperature in the range of from about 850° C. to about 1050° C., over a time period of in the range of from about 1 second to about 5 hours, and holding said composite material in a temperature range near said phase transformation temperature until an amount of said first Ti transforming phase in the range of from about 1 vol % to about 100 vol %, has undergone said phase transformation.

50. The method of claim 49 wherein said composite material is held at a temperature above said phase transformation temperature and at a temperature below said phase transformation temperature for a holding time period in the range of from about 1 second to about 5 hours.

51. The method of claim 49 wherein said composite material is held at a temperature above said phase transformation temperature and at a temperature below said phase transformation temperature for a holding time period in the range of from about 1 minute to about 1 hour.

52. The method of claim 49 wherein said composite material is held at a temperature above said phase transformation temperature and at a temperature below said phase transformation temperature for a holding time period in the range of from about 2 minutes to about 5 minutes.

53. The method of claim 47 further comprising repeating steps (2) and (3) a plurality of times so that large deformations are achieved by superplastic deformation during each such repetition while maintaining the mechanical integrity of the material.

54. The method of claim 47 wherein said external stress is a uniaxial tensile stress and is further characterized by a stress magnitude in the range of from about 0.05 MPa to about 10 MPa

55. The method of claim 47 wherein in step (1) of providing said Ti/TiC composite material, said first Ti transforming phase is present in an amount in the range of from about 95 vol % to about 10 vol %.

56. The method of claim 47 wherein in step (1) of providing said Ti/TiC composite material, said first Ti transforming phase is present in an amount in the range of from about 90 vol % to about 60 vol %.

57. The method of claim 47 wherein said step (2) of thermally cycling said first Ti transforming phase through a phase transformation is accomplished by heating said Ti/TiC composite material to a phase transformation temperature in the range of from about 860° C. to about 900° C. over a time period of more in the range of from about 10 seconds to about 1 hour and holding said composite material in a temperature range near said phase transformation temperature until an amount of said first Ti transforming phase in the range of from about 10 vol % to about 100 vol % has undergone said phase transformation.

58. The method of claim 47 wherein said step (2) of thermally cycling said first Ti transforming phase through a phase transformation is accomplished by heating said Ti/TiC composite material to a phase transformation temperature in the range of from about 880° C. to about 884° C. over a time period of most preferably in the range of from about 30 seconds to about 5 minutes and holding said composite material in a temperature range near said phase transformation temperature until an amount of said first Ti transforming phase in the range of from about 50 vol % to about 100 vol % has undergone said phase transformation.

59. The method of claim 47 wherein said external stress is a uniaxial tensile strength and is further characterized by a stress magnitude in the range of from about 0.1 MPa to about 5 MPa.

60. The method of claim 47 wherein said external stress is a uniaxial tensile strength and is further characterized by a stress magnitude in the range of from about 0.3 MPa to about 3 MPa.

* * * * *

UNITED STATES PATENT AND TRADEMARK OFFICE

CERTIFICATE OF CORRECTION

PATENT NO. : 5,413,649

DATED : May 9, 1995

INVENTOR(S) : David C. Dunand et al.

It is certified that error appears in the above-identified patent and that said Letters Patent is hereby corrected as shown below:

Column 2, line 9: change "$\alpha 77 \rightarrow$", to --$\alpha \leftrightarrow \beta$--.

Column 5, line 5: change "$Cr_5GE_3$" to --$Cr_5Ge_3$--.

Column 7, in Table 2: change "Bi" to --$\zeta$Bi--.

Column 7, in Table 2: change "$\beta$Gd" to --$\beta$Ge--.

Column 7, in Table 2: change "$\beta$Ge" to --$\gamma$Ge--.

Column 7, in Table 2: change "$\gamma$Ge" to --$\delta$Ge--.

Column 10, line 54: after "$Pa^{-1}$" (1st. occ.) insert --Ti--.

Column 13, line 62: change "$1.1x10^{-9}$" to --$1.1x10^{-3}$--.

Column 14, claim 1, line 62: change "along" to -- alone --.

Column 17, claim 34, line 34: change "$CrsGe_5$" to --$Cr_5Ge_3$--.

Column 17, claim 39, line 53: change "a volume containing a fraction" to --containing a volume fraction--.

Column 20, claim 59, line 22: change "strength" to --stress--.

Column 20, claim 60, line 26: change "strength" to --stress--.

Signed and Sealed this

Eleventh Day of July, 1995

Bruce Lehman

*Attest:*

BRUCE LEHMAN

*Attesting Officer*

*Commissioner of Patents and Trademarks*